United States Patent [19]

Christie et al.

[11] 4,066,390

[45] Jan. 3, 1978

[54] STABLE HYDROSULFITE COMPOSITIONS

[76] Inventors: Nick J. Christie, 29 Dean Road, Mendham, N.J. 07945; Joseph P. Antisavage, 220 E. Washington Ave., Newtown, Pa. 18940; Eugene E. Brupbacher, 270 E. Mountain Road, Sparta, N.J. 07871

[21] Appl. No.: 642,366

[22] Filed: Dec. 19, 1975

Related U.S. Application Data

[63] Continuation-in-part of Ser. No. 388,354, Aug. 15, 1973, abandoned.

[51] Int. Cl.[2] ..... D06L 3/00

[52] U.S. Cl. ..... 8/110; 8/34; 252/188; 423/275

[58] Field of Search ..... 8/34, 73, 74, 102, 89 R, 8/107, 110; 252/188; 423/515, 275

[56] References Cited

U.S. PATENT DOCUMENTS

| | | | |
|---|---|---|---|
| 2,516,321 | 7/1950 | Hurd et al. | 252/188 |
| 3,054,658 | 9/1962 | Franklin et al. | 417/115 |
| 3,433,574 | 3/1969 | Durch et al. | 8/89 |
| 3,669,895 | 6/1972 | Shastri | 252/188 |
| 3,794,738 | 2/1974 | Ellis et al | 423/515 |
| 3,819,807 | 6/1974 | Schreiner et al. | 252/188 |

FOREIGN PATENT DOCUMENTS

| | | |
|---|---|---|
| 888,605 | 12/1971 | Canada. |
| 384,903 | 12/1932 | United Kingdom. |

*Primary Examiner*—William E. Schulz
*Attorney, Agent, or Firm*—Theodore J. Dettling

[57] ABSTRACT

A stable hydrosulfite composition particularly useful for treating a dyed or tinted textile is provided by a homogeneous particulate admixture of a hydrosulfite, a pH builder salt and a pH buffer salt, and either detergent or stabilizer, or both.

20 Claims, No Drawings

STABLE HYDROSULFITE COMPOSITIONS

RELATED APPLICATIONS

This is a continuation in part of USS Ser. No. 388,354 filed Aug. 15, 1973, and now abandoned.

BACKGROUND OF THE INVENTION

1. Field of the Invention

This invention relates to stable hydrosulfite-based compositions particularly useful for treating dyed or tinted textiles.

2. Description of the Prior Art

The use of hydrosulfites in dyeing processes and in treating both undyed and dyed textiles is known. Illustrative of these uses are the disclosures in the following known patents.

U.S. Pat. No. 1,181,906 discloses the use of alkali metal hydrosulfite in dyeing animal textile fibers with sulfur dyestuffs.

U.S. Pat. No. 1,847,698 discloses bleaching the non-immunized cotton component of a composite fabric with hydrosulfite after printing or dyeing.

U.S. Pat No. 1,959,406 discloses the use of sodium hydrosulfite for pre-shrinking textiles.

U.S. Pat. No. 3,127,231 discloses vat dyeing or dye stripping with a reducing composition including hydrosulfite, sodium borohydride, and alkali metal hydroxide.

U.S. Pat. No. 3,567,589 discloses the use of a caustic-hydrosulfite reducing bath in dyeing polyester/cotton fabrics with vat/disperse dye systems.

U.S. Pat. No. 3,607,373 discloses treating polyolefin fibers with aqueous metal hydrosulfite to improve thermal stability.

In treating dyed textiles, hydrosulfites have been employed for afterclearing and scouring dyed synthetic textiles, especially dyed polyesters. In particular, compositions have been used comprising solium hydrosulfite, sodium hydroxide or sodium carbonate, detergent, and sequestering agent (e.g., EDTA or sodium hexametaphosphate) added separately to and mixed in the final rinse after dyeing. While effective, this prior practice of separately adding each ingredient to and mixing in the rinse bath to form the clearing and scouring composition is undesirable because it is time consuming, inaccurate, and inefficient. For example, caking of the ingredients during mixing occurs if the water temperature is not exactly right; and the hydrosulfite is unstable and loses its strength in environments having any appreciable humidity. Further, it is hazardous due to the corrosive nature of the caustic and the inflammability of the hydrosulfite. Illustrative of known prior art employing such a procedure are French Pat. No. 1,202,744, U.S. Pat. No. 3,174,816, Canadian 888,605 (hydrosulfite and detergent used as a premixed material), and CHEMIFASERN (W. Kunz), Vol. 20, No. 5, 1970, pages 398-401.

In addition, aqueous hydrosulfite solutions, like those used for clearing and scouring, have been employed for decoloring or removing the tint from synthetic fibers tint dyed for textiletype and lot identification by the fiber manufacturer, and for stripping dyed synthetic textiles to lighten their hue. In so far as the applicant knows, these further applications of hydrosulfite have also employed separate additions and mixing of ingredients at the time of use, and hence have the same inherent disadvantages and problems.

The problem of hydrosulfite instability and/or inflammability has been addressed by the prior art and has been alleviated with varying degrees of success by admixing the hydrosulfite with:

a. Anhydrous sodium or potassium salts of a benzoic acid or an alkanoic acid containing 1 to 18 carbon atoms (U.S. Pat. No. 3,054,658); or
b. Dry alkali-metal compound(s) (British Pat. No. 384,903); or
c. Non-ionic, cationic or amphoteric surfactants (Canadian Pat. No. 888,605).

Other stabilizers are disclosed in U.S. Pat. No. 3,794,738; U.S. Pat. No. 3,669,895; U.S. Pat. No. 2,516,321; U.S. Pat. No. 3,819,807; and U.S. Pat. No. 3,474,037. Of these, only Canadian Pat. No. 888,605 appears to teach that the disclosed stablized hydrosulfite mixture can be used as a replacement for unstabilized hydrosulfite in aqueous baths used for cleaning and scouring or stripping dyed synthetic textiles. Such baths would be expected to still require the separate addition of at least caustic and, if necessary, sequestering agent.

SUMMARY OF THE INVENTION

Considering this state of the art, it is an object of this invention to provide stable one-package hydrosulfite compositions particularly useful for treating dyed or tinted synthetic textiles, which do not have the afore-described deficiencies, and are efficacious, inter alia, for clearing and scouring or stripping dyed synthetic textiles and for decoloring tinted synthetic textiles.

This and other objects and advantages, which will be apparent from the following description and examples, are provided by a one-package hydrosulfite composition comprising an intimate homogeneous particulate admixture of the following ingredients, described in detail hereinafter, expressed in parts by weight based on 100 parts of 100%-assay hydrosulfite:

| | | |
|---|---|---|
| Hydrosulfite | | 100 |
| pH Builder | | 37.5 – 214 |
| pH Buffer | | 37.5 – 286 |
| | and | |
| Stabilizer | | 0.9 – 14.15 |
| | and/or | |
| Detergent | | 3.4 – 107 |

This admixture provides a dry, flowable composition that is an effective, economical, storage-stable, and safe replacement for hydrosulfite compositions present used in treating dyed or tinted synthetic textiles.

DESCRIPTION OF THE PREFERRED EMBODIMENTS

In the following description of ingredients, and in the claims, all parts are by weight and are based on 100 parts of 100%-assay hydrosulfite.

The preferred hydrosulfite because of its lower cost is sodium hydrosulfite (also known as sodium dithionate or sodium sulfoxylate) having the formula $Na_2S_2O_4$ and generally available with a hydrosulfite assay in the range of about 88–94%. It is a flammable material and subject to violent combustion if allowed to become damp. Other water-soluble hydrosulfites, such as potassium, ammonium, or zinc hydrosulfite, may also be used. Only one, or mixtures of two or more different hydrosulfites may be used.

Useful pH builders include sodium carbonate, sodium sesquicarbonate and sodium bicarbonate. Less preferred because of their higher costs but equally suitable are the corresponding potassium or ammonium salts. The carbonate salts, being most alkaline and least expensive, are preferred. One or a mixture of pH builders can be used. While about 37.5–214 parts of pH builder may be used, generally, optimum results are obtained with about 75–175 parts.

As pH buffers there can be used one or a mixture of materials such as sodium tripolyphosphate, tetrasodium pyrophosphate, trisodium phosphate, disodium phosphate, borax, and sodium silicates, having a molar ratio of silica to sodium oxide of about 0.5 to 3.3. Equally useful, but less preferred because of their higher costs, are the corresponding potassium and stable ammonium salts. Maximum cost effectiveness has been obtained with trisodium and sodium metasilicate, and, hence, they are preferred. While about 37.5–286 parts of pH buffer may be used, the preferred range is about 60–175 parts.

The stabilizer, employed in an amount of about 0.9–14.15 parts in the invention composition to provide improved storage stability, is a sodium or potassium salt of an alkanoic acid having 1-12 carbon atoms or a benzoic acid that may have ring substituents such as an amino, hydroxy, or methyl group. The use of these materials is described in U.S. Pat. No. 3,054,658. Sodium benzoate and sodium acetate have been found to be especially effective. If desired, mixtures of the stabilizers may be used. For maximum storage stability, especially in an environment of high humidity, about three or more parts are used. Besides improving storage stability, the stabilizer has surprisingly been found to improve the clearing and scouring efficiency of the invention compositions (as measured by the washfastness test).

The detergent, employed in an amount of about 3.4–107 parts in the invention composition, may be any anionic, ampholytic, or nonionic surfactant having soap-like cleaning action and minimal or no deletereous effect on the storage stability and reducing properties of the invention composition. Suitable types of detergents include, but are not limited to: alkali metal alkyl and alkaryl sulfonates, alkali metal salts of sulfated fatty acids, ethoxylated amines, ethoxylated fatty acids, ethoxylated fatty alcohols, ethoxylated alkylphenols, fatty acid ester sulfates, ethoxylated fatty acid alkanolamides, alkyl amido sulfates, phosphated linear alcohol ethoxylates, ethoxylated amino acid salts, and the alkyl betaines alkali metal salts. Examples of specific useful detergents include, but are not limited to: stearic alcohol ethoxylated with about 32 moles of ethylene oxide, nonylphenol ethoxylated with from about 30 to about 100 moles of ethylene oxide, sodium stearate, glycerol monostearate, tall oil acid or lauric acid ethoxylated with about 13 moles of ethylene oxide, sodium lauryl sulfate, sodium isopropyl naphthalene sulfonate, potassium n-butyl naphthalene sulfonate, dioctyl sodium sulfosuccinate, and sodium N-methyl-N-oleyltaurate. Only one, or mixtures of different detergents may be used. Since better results are usually obtained with nonionic surfactants, they are generally preferred. To date, best results have been obtained with nonylphenol ethoxylated with about 100 moles of ethylene oxide and tall oil acid or lauric acid ethoxylated with about 13 moles of ethylene oxide. Conversely, a nonylphenol nonionic having about 15 or less moles of condensed ethylene oxide has been found to be generally unsatisfactory because it caused product instability and lessened the reducing and, hence, clearing properties of the invention composition. For maximum effectiveness, typically, about 10 or more parts of detergent are used. Further, when it is desired to minimize dusting of the invention composition, liquid detergents are preferrably employed.

While invention compositions containing only either stabilizer or detergent provide good scouring and clearing, best results are obtained with respect to storage stability and scouring and clearing effectiveness when both are used.

In addition to the foredescribed essential ingredients, the invention composition may also contain other adjuvants customarily employed in textile treating processes, as for example defoaming agents, sequestering agents, and the like; care being taken to choose only those adjuvant materials exhibiting compatability and not significantly affecting the storage stability and reducing properties of the invention products.

The invention composition is simply produced by admixing the ingredients in conventional powder mixing equipment, such as a rotating blender, for a time sufficient to give an essentially homogeneous admixture. If compositions having finer particle size are desired, a disintegrating mill can be used at some stage in the mixing. When liquid ingredients are used, most efficient mixing sometimes is achieved by blending all the particulate dry ingredients first for some finite period such as 15 minutes before admixing the liquid ingredients. Further, maximum stabilizer effectiveness may, in some instances, be promoted by first admixing it and the hydrosulfite. Lastly, since hydrosulfites are particularly subject to degradation if moisture or excess humidity is present, mixing conditions should be used that prevent or minimize free water or moisture in the invention compositions and the ingredients used should be either anhydrous or contain only bound water of hydration.

The dyed or tinted textiles treated with the invention compositions are synthetic textiles, such as nylon, polyester, acrylic, polyolefin and the like, either dyed or printed with disperse and/or basic dyestuffs or tinted with dyes. Also, some synthetic textiles dyed with anionic dyes may be effectively treated. The textile may be in the form of the fibers (staple, yarn, or continuous), fabrics (woven, nonwoven, knitted, tufted, and the like), or finished textile goods; and may consist of only one type of synthetic, mixtures of synthetics, or mixtures of a synthetic with a natural textile material, such as cotton, wool, silk and the like.

When employed for clearing and scouring--most usually polyester-containing textiles dyed with dispersed dyestuffs--the invention composition is typically used according to the following procedure found effective for dyed polyester fabric. After the last overflow rinse of the dye cycle, the composition is added, usually predissolved in water, to the bath, having about 1:10 to 1:40 liquor ratio and set at about 120°–140° F, in an amount of about 2–6% o.w.f. depending on the dye type and the depth of the dye shade; the temperature of the bath raised to 170°–180° F; and the goods run for 20–30 minutes. The bath is then cooled with an overflow rinse for 5–10 minutes, neutralized with acetic acid, rinsed again, and the bath dropped. For package-dyed yarn, a similar procedure may be used except that the bath is set initially at about 120° F and about 4–6% o.w.f. of the invention composition is used together with about 0.25% of a sequestering agent such as EDTA.

When employed to strip solid or multicolored dyed synthetic textiles (either to lighten or virtually remove the dye color), the invention composition is typically used as follows. The dye beck containing the dyed goods and water is heated rapidly to a boil; the invention compostion predissolved in water added (to give a final liquor ratio of about 1:10 to 1:40); and the goods run at about 205° F until the desired color reduction is obtained (about 30 minutes or more). The treating bath is then dropped and the goods rinsed at 120°–140° F. The quantity of the invention composition required for stripping will depend, inter alia, upon the type of textile, the type and hue of the dye, and the color reduction desired. Generally, bearing this in mind, the following quantities of o.w.f. will be found satisfactory: 2–3% for light shades, 4–6% for medium shades, and 7–10% for dark shades.

When used for removing tints that are difficult to remove, the invention composition (usually in amount of about 2–3% o.w.f.) is used in the same way as for stripping except that the running time is reduced to about 15 minutes. When the tint is more readily removed, then a running temperature of only about 120° F is normally required.

As will be apparent to those skilled in the art, the foregoing description of various treating procedures employing the invention compositions is not all-inclusive but is merely illustrative of those found efficacious for certain textiles dyed or tinted with certain dyestuffs; and that other parameters and possibly additives may be required for other textiles and dyes as can be easily ascertained using the foregoing as a starting point.

EXAMPLE I

Thirty parts by weight of sodium hydrosulfite (92% assay), 0.25 parts by weight of sodium benzoate, 35.75 parts by weight of trisodium phosphate (powder, anhydrous), and 25.00 parts by weight of sodium carbonate were charged into a mixing tank and blended for 15 minutes. Nine parts by weight of a nonionic detergent, which was a tall oil acid ethoxylated with about 13 moles of ethylene oxide, was then sprayed into the mixing tank and blending was continued for 1½ to 2 hours. The resulting composition was useful as an after-treatment for textiles within the scope of the invention. It consisted of a free-flowing and dust-free white powder assaying it at about 28.0% by weight 100%-assay sodium hydrosulfite.

The composition was tested for dusting by half-filling a 100 ml graduate, covering the graduate, and inverting five times. No dust came out of the graduate when the top was removed.

A second test was run to determine the stability of the composition in the presence of moisture at elevated temperatures. The test simulates the method used by the United States Bureau of Explosives to determine if a yellow cautionary label is required for shipping. In the test, two 250-gram portions of the product in 600 ml beakers are heated to 120° F, 25 mls of water at 120° F are poured evenly over the top of one portion and the second portion poured from its beaker over the wetted portion, the wetted mixture placed in an oven at 120° F with a thermocouple inserted in the center, and the temperature recorded over a 6 hour period. The invention composition exhibited a modest temperature rise to 180° F and then gradually cooled to the oven temperature. Sodium hydrosulfite, on the other hand, developed a temperature that soared above 600° F when similarly tested. As the temperature reached by the invention composition was less than 200° F, it can be shipped without a yellow caution label, in contradistinction to hydrosulfites that must be shipped and handled with great care.

In yet another test conducted to determine the shelf life of the formulated product, sodium hydrosulfite assay values of the product of Example I were determined at time intervals after blending. Starting with an initial assay value of 28% hydrosulfite, the product of Example I was found to have assay values of 28.1% and 27.8% after three weeks indicating that it has good shelf life since the change in assay value was negligible.

Because no competitive one-package compositions were known, the Example I composition was evaluated against a hydrosulfite clearing and scouring composition typical of those used in the industry that was made by separately adding to and mixing in the final rinse bath predissolved aqueous solutions of the following ingredients: 3 parts of sodium hydrosulfite (92% assay), then 0.5 parts of EDTA and 0.4 parts of a nonionic detergent, and lastly 3.5% parts of sodium hydroxide. The evaluation was made by comparing the effectiveness of Example I product versus the prior art composition at 4.0% and 7.4% o.w.f. for scouring and clearing the following dyed textiles.

1. A doubleknit polyester fabric dyed with either;
   a. 2% o.w.f. of Disperse Blue 56 (Resolin Blue FBLD), or
   b. 2% o.w.f. of Disperse Red 78 (Artisil Scarlet 2GFL)
2. Polyester yarn packages pressure dyed with either;
   a. 4% o.w.f. of Disperse Blue 56(Resolin Blue FBLD), or
   b. 2.5% o.w.f. of Dispersed Red 78 (Artisil Scarlet 2GFL)

Test swatches of the dyed polyester knit were treated for 20 minutes at 170° F with either 4.0% or 7.4% o.w.f of the clearing composition in a bath having a 30:1 liquor ratio, and were then cold rinsed, spin-extracted, and dried. None of the test swatches exhibited any color change after the clearing and scouring treatment.

The packages of the dyed polyester yarns, on the other hand, were treated with 7.4% o.w.f. of the clearing composition in a bath having a 15:1 liquor ratio for 15 minutes at 180° F, then 5 minutes at 160° F, and finally 5 minutes at 140° F. Then the packages were continuously wash-rinsed for 5 minutes, spinextracted, and dried. None of the package yarns showed any change in color after clearing and scouring, and a knitted sleeve was prepared from each for colorfastness testing.

After being cleared and scoured, test swatches from each of the after-treated polyester knits and polyester yarns (knitted into sleeves) as well as control swatches from both dyed textiles having no after treatment were tested for dry and wet crocking by AATCC Method 8-1969, and for washfastness by AATCC Test Method 8-1969 using Test II A test conditions in Table 1 and multifiber test fabric No. 1. The colorfastness of the test and control swatches in the crocking and washfastness tests was determined by AATCC Evaluation Procedure 2 "Gray Scale for Staining" which uses a scale of 1 to 5, with 5 representing no color transfer and 1 representing a severe color transfer or staining. In the washfastness test, the nylon segment of the multifiber test fabric, the part most heavily stained, was used for determining the degree of color transfer.

The colorfastness test results for the after-treated dyed polyester fabric and the after-treated dyed polyester yarn, compiled in the Tables 1 and 2 respectively, show that the invention composition of Example 1, on average, is comparable in clearing and scouring efficiency to a composition typically used by the dyeing industry, even though it contains 26% less of the primary ingredient, sodium hydrosulfite, responsible for clearing unfixed surface dye.

TABLE 1

| COLORFASTNESS OF DYED POLYESTER FABRIC CLEARED & SCOURED | | | |
|---|---|---|---|
| | Untreated | Example I | Prior Art |
| Dyed with Disperse Blue 56 | | | |
| 4.0% o.w.f. | | | |
| Dry Crocking | 1.5 | 5.0 | 5.0 |
| Wet Crocking | 1.5 | 4.5 | 4.5 |
| Washfastness | 1.0 | 3.5 | 4.0 |
| 7.4% o.w.f. | | | |
| Dry Crocking | 1.5 | 5.0 | 5.0 |
| Wet Crocking | 1.5 | 5.0 | 5.0 |
| Washfastness | 1.0 | 4.0 | 4.0 |
| Dyed with Disperse Red 78 | | | |
| 4% o.w.f. | | | |
| Dry Crocking | 2.5 | 5.0 | 5.0 |
| Wet Crocking | 3.0 | 5.0 | 5.0 |
| Washfastness | 1.0 | 4.0 | 4.0 |
| 7.4% o.w.f. | | | |
| Dry Crocking | 2.5 | 5.0 | 5.0 |
| Wet Crocking | 3.0 | 5.0 | 5.0 |
| Washfastness | 1.0 | 4.5 | 4.0 |

TABLE 2

| COLORFASTNESS OF DYED POLYESTER YARN CLEARED & SCOURED | | | |
|---|---|---|---|
| | Untreated | Example I | Prior Art |
| Dyed with Disperse Blue 56 | | | |
| Dry Crocking | 2.5 | 4.5 | 4.5 |
| Wet Crocking | 3.0 | 5.0 | 5.0 |
| Washfastness | 2.5 | 5.0 | 4.0 |
| Dyed with Disperse Red 78 | | | |
| Dry Crocking | 2.0 | 5.0 | 5.0 |
| Wet Crocking | 3.0 | 5.0 | 5.0 |
| Washfastness | 2.0 | 4.0 | 4.5 |

EXAMPLES 2-17

A series of clearing and scouring compositions, Examples 2-17 in Tables 3 and 4, were produced by homogeneously blending together different amounts of sodium hydrosulfite (90% assay), anhydrous sodium carbonate, and anhydrous trisodium phosphate, together with different amounts of polyethylene ether laurate (nonionic detergent having about 13 condensed ethylene oxide groups) and/or sodium benzoate. The compositions were tested for clearing and scouring 10-gram test swatches cut from two large pieces of doubleknit polyester fabric, designated Fabric I and II, that had been dyed on different days in a laboratory dye beck employing a 40:1 liquor ratio dyebath containing 2% o.w.f. Disperse Red 176, 2% o.w.f. Disperse Red 60, and 2% o.w.f Disperse Red 68. After dyeing, the fabrics had been cold rinsed and dried. The compositions of Examples 2-7 plus two compositions, designated A and B, were used for treating the test swatches cut from Fabric I (Table 3), while the compositions of Examples 8-17 were used for treating the test swatches cut from Fabric II (Table 4). Composition A was identical to those of Examples 2 and 5-17 except that it contained neither detergent nor stabilizer; while composition B is a clearing and scouring composition used by one of the largest dye houses in the United States, and is believed to be representative of compositions employed in the dye industry for clearing and scouring.

In treating the test swatches, an amount of each test composition sufficient to provide 0.86% o.w.f of the 90%-assay sodium hydrosulfite was predissolved in a small amount of water, the solution added to an individual tube of an Ahiba Lab Dyeing Machine containing enough water at 170° F to give a 30:1 liquor ratio, and the dyed test swatch immersed and agitated at 170° F. After 20 minutes of agitation, the bath was dropped and the fabric rinsed in cold running water, spin dried to remove excess water, and dried at 150° F in a circulating hot air oven. A control swatch from each dyed fabric, treated under the same conditions with water only, was also run, and are denominated $C_1$ (Fabric I) and $C_2$ (Fabric II) in Tables 3 and 4.

The effectiveness of each composition for after-treating was determined by testing each treated swatch for washfastness by AATCC Test Method 61-1972, using Test III A test conditions described in Table 1 of the Test Method and multifiber test fabric No. 1; and for dry and wet crocking by AATCC Test Method 8-1972. In these tests, the colorfastness values of the swatches, compiled in Tables 3 and 4, was determined, as was done in Example 1, by AATCC Evaluation Procedure 2 "Gray Scale for Staining" with the fastness ratings being expressed as a decimal fraction for ratings falling between whole number units (e.g. 3-4 is written as 3.5) to facilitate averaging out the ratings for the washfastness test, which was run in duplicate. Both of the duplicate results, as well as their average, are given in the tables and are based on the staining of the nylon segment of the multifiber test fabric, the part most heavily stained. For consistency, the colorfastness ratings of the dry and wet crocking tests were, similarly, compiled using the decimal system.

TABLE 3[1]

| Example | 2 | 3 | 4 | 5 | 6 | 7 | A | B | $C_1$ |
|---|---|---|---|---|---|---|---|---|---|
| Sodium Hydrosulfite | 33 | 33 | 33 | 33 | 33 | 33 | 33 | 33 | CONTROL[3] |
| Sodium Carbonate | 27 | 41.4 | 16.8 | 27 | 27 | 27 | 27 | — | " |
| Trisodium Phosphate | 35 | 20.6 | 45.2 | 35 | 35 | 35 | 35 | — | " |
| PEG 600[2] Laurate | 4 | 4 | 4 | 4 | — | — | — | — | " |
| Sodium Benzoate | 1 | 1 | 1 | — | 1 | 0.27 | — | — | " |
| E.D.T.A. | — | — | — | — | — | — | — | 5.4 | " |
| NaOH (solid) | — | — | — | — | — | — | — | 38.5 | " |
| Igepon T-77 | — | — | — | — | — | — | — | 4.4 | " |
| Washfastness, Test 1 | 3.5 | 3.5 | 3.5 | 3.5 | 2.5 | 2.5 | 2.0 | 2.5 | 1.0 |
| Washfastness, Test 2 | 3.5 | 3.5 | 3.5 | 3.5 | 3.0 | 3.0 | 2.0 | 2.0 | 1.0 |
| Washfastness, Average | 3.5 | 3.5 | 3.5 | 3.5 | 2.75 | 2.75 | 2.0 | 2.25 | 1.0 |
| Dry Crocking | 4.5 | 4.5 | 4.5 | 4.5 | 4.5 | 4.5 | 4.5 | 4.0 | 2.5 |

TABLE 3[1]-continued

| Example | 2 | 3 | 4 | 5 | 6 | 7 | A | B | $C_1$ |
|---|---|---|---|---|---|---|---|---|---|
| Wet Crocking | 5.0 | 5.0 | 5.0 | 5.0 | 5.0 | 5.0 | 5.0 | 5.0 | 3.0 |

[1]All experiments run on test swatches cut from dyed Fabric I
[2]Polyethyene glycol having molecular weight of 600.
[3]After-treated with only water.

TABLE 4[1]

| Example | 8 | 9 | 10 | 11 | 12 | 13 | 14 | 15 | 16 | 17 | $C_2$ |
|---|---|---|---|---|---|---|---|---|---|---|---|
| Sodium Hydrosulfite | 33 | 33 | 33 | 33 | 33 | 33 | 33 | 33 | 33 | 33 | CONTROL[3] |
| Sodium Carbonate | 27 | 27 | 27 | 27 | 27 | 27 | 27 | 27 | 27 | 27 | " |
| Trisodium Phosphate | 35 | 35 | 35 | 35 | 35 | 35 | 35 | 35 | 35 | 35 | " |
| PEG 600[2] Laurate | 4 | 4 | 3 | 3 | 2 | 2 | 1 | 1 | 2 | — | " |
| Sodium Benzoate | 1 | — | — | 0.27 | — | 0.27 | — | 0.27 | 1 | 0.27 | " |
| Washfastness, Test 1 | 3.0 | 3.0 | 3.0 | 3.0 | 2.5 | 2.0 | 2.5 | 3.0 | 2.0 | 2.0 | 1.0 |
| Washfastness, Test 2 | 3.0 | 3.0 | 3.0 | 3.0 | 2.5 | 3.0 | 3.0 | 2.5 | 2.0 | 2.0 | 1.0 |
| Washfastness, Average | 3.0 | 3.0 | 3.0 | 3.0 | 2.5 | 2,5 | 2.75 | 2.75 | 2.0 | 2.0 | 1.0 |
| Dry Crocking | 4.0 | 4.0 | 4.0 | 4.0 | 4.0 | 4.0 | 4.0 | 4.0 | 4.0 | 4.0 | 2.0 |
| Wet Crocking | 5.0 | 5.0 | 5.0 | 5.0 | 5.0 | 5.0 | 5.0 | 5.0 | 2.05.0 | 2.0 | |

[1]All experiments run on test swatches cut from dyed Fabric II.
[2]Polyethyene glycol having molecular weight of 600.
[3]After-treated with only water.

From the colorfastness data in Tables 3 and 4, it appears that the following observations pertain in evaluating the experiments performed with the compositions of Examples 2–17 and compositions A and B.

1. Test Fabric II appear to have been dyed to a darker shade than Fabric I (i.e., the dyes were more completely exhausted onto Fabric II than Fabric I) based on the greater staining obtained in the colorfastness tests for the compositions of Examples 8, 9 and 17 using Fabric II, versus the staining obtained in the colorfastness tests for the compositions of Examples 2, 5 and 7 respectively indentical thereto using Fabric I; and that it is necessary, therefore, to add 0.5 units to the colorfast ratings of Table 4 if one is to make meaningful comparisons of the data of Tables 3 and 4.

2. The washfastness test was not 100% reproducible in a few of the experiments (due, it is believed, either to variation in the dye intensity over the whole area of the test swatch and/or to experimental error in the test), and that, therefor, average values of the duplicate results should be used for comparison purposes.

3. The washfastness results for Example 16 are anomalous and not representative due, it is believed, to experimental error and should not, therefore, be considered in analyzing the data.

4. Equal colorfastness ratings are obtained in the wet and dry crocking tests for nearly all of the after-clearing compositions. Hence, at the hydrosulfite level used in all of the experiments (0.86% o.w.f of the 90%-assay hydrosulfite), these tests do not seem to be as sensitive to formula variations as the washfastness test.

Bearing in mind the foregoing observations, the colorfastness data (particularly the washfastness data) from the experiments compiled in Table 3 and 4 show that:

1. The invention after-treating compositions (Examples 2–15 and 17) are superior to composition B, believed to be typical of the scouring and clearing formulations known and used by the prior art.

2. The invention after-treating compositions, also, are superior to composition A, thus showing that the addition of 0.27 parts or more of thermal stabilizer and/or 1 part or more parts of detergent per 33 parts of hydrosulfite (90% assay) contributes to the efficacy of the invention compositions.

EXAMPLES 18–22

A second series of clearing and scouring compositions, Examples 18–22 in Table 5, were produced by homogeneously blending together sodium hydrosulfite (90% assay), anhydrous sodium carbonate, either anhydrous trisodium phosphate or anhydrous sodium metasilicate, polyethylene ether laurate (nonionic detergent having about 13 condensed ethylene oxide groups), and either sodium benzoate or sodium acetate. Three additional compositions, designated C, D & E in Table 5, were also prepared to test the stabilized sodium hydrosulfites disclosed in Canadian Pat. No. 888,605 containing homogeneously admixed nonionic detergent (preferred stabilizing agent) and either sodium carbonate, trisodium phosphate or sodium benzoate (free-flowing agent). The compositions were tested for clearing and scouring 10-gram test swatches cut from two large pieces of doubleknit polyester fabric, designated Fabric III and IV, that had been separately dyed in a laboratory dye beck employing a 40:1 liquor ratio dyebaths containing 2% o.w.f. Disperse Red 176, 2% o.w.f. Disperse Red 60, and 2% o.w.f. Disperse Red 68 for Fabric III, and 4% o.w.f. Disperse Blue 56 for Fabric IV. After dyeing, the fabrics had been rinsed with cold water and dried.

The fabric swatches were treated and tested for washfastness and crocking using the same clearing and evaluation procedures employed for Examples 2–17. Additionally, the stability of the compositions was determined by:

1. The moisture-exotherm test described in Example 1.

2. A hydrosulfite assay after 13 days storage at room temperature in a closed container.

3. A retest of clearing efficiency (for Fabric IV) after 37 days aging at room temperature in a closed container.

TABLE 5

| | Invention Compositions | | | | | Canadian 888,605 Compositions | | |
|---|---|---|---|---|---|---|---|---|
| Composition Ingredients | 18 | 19 | 20 | 21 | 22 | D | E | F |
| Sodium Hydrosulfite[1] | 110 | 110 | 110 | 110 | 110 | 110 | 110 | 110 |
| Sodium Carbonate[2] | 147 | 44 | 44 | 44 | 44 | 44 | — | — |
| Trisodium Phosphate[2] | — | — | 44 | 44 | 44 | — | 44 | — |

TABLE 5-continued

| Composition Ingredients | Invention Compositions | | | | | Canadian 888,605 Compositions | | |
|---|---|---|---|---|---|---|---|---|
| | 18 | 19 | 20 | 21 | 22 | D | E | F |
| Sodium Metasilicate[2] | 92 | 44 | — | — | — | — | — | — |
| PEG[3] Laurate | 14.7 | 13 | 13 | 13 | 44 | 44 | 44 | 44 |
| Sodium Benzoate[2] | 3.7 | 3.3 | 3.3 | — | 3.3 | — | — | 44 |
| Sodium Acetate[2] | — | — | — | 3.3 | — | — | — | — |
| Fabric III (Red) Clearing | | | | | | | | |
| Washfastness | 4.0 | 3.5 | 3.5 | 3.5 | 3.0 | 3.5 | 3.0 | 3.0 |
| Fabric IV (Blue) Clearing | | | | | | | | |
| Washfastness | 4.0 | 3.0 | 3.0 | 3.5 | 3.5 | 3.0 | 2.5 | 2.0 |
| Dry Crocking | 4.5 | 4.5 | 4.5 | 4.5 | 4.5 | 4.5 | 4.5 | 4.0 |
| Wet Crocking | 4.5 | 4.5 | 4.5 | 4.5 | 4.5 | 4.5 | 4.5 | 4.0 |
| Stability Tests | | | | | | | | |
| Fabric IV (Blue) Clearing[4] | | | | | | | | |
| Washfastness | 4.0 | 3.5 | 3.0 | 3.5 | 3.5 | 2.5 | 2.5 | 2.0 |
| Dry Crocking | 4.5 | 4.5 | 4.5 | 4.5 | 4.5 | 4.5 | 4.5 | 4.0 |
| Wet Crocking | 4.5 | 4.5 | 4.5 | 4.5 | 4.5 | 4.5 | 4.5 | 4.0 |
| Moisture Exotherm(° F)[5] | 202 | 230 | 220 | 210 | 170 | 220 | 240 | 238 |
| % Hydrosulfite[6] | 26.1 | 26.8 | 26.0 | 26.6 | 26.3 | 25.5 | 24.1 | 25.7 |

[1]90% assay hydrosulfite
[2]Anhydrous[3]Polyethylene glycol having a molecular weight of 600
[4]After aging composition 37 days at room temperature in a closed container
[5]Maximum temperature reached
[6]After aging composition 13 days at room temperature in a closed container The data in Table 5 indicates that the invention compositions, Examples 18–22, as compared to the stabilized hydrosulfites of Canadian Pat. No. 888,605, compositions D, E and F, are, on average, superior in clearing and scouring, and have superior stability.

From the foregoing description and examples, it can be seen that the present invention provides hydrosulfite compositions having a high degree of stability, and, inter alia, particular effectiveness in treating dyed and tinted synthetic textiles for clearing and scouring, stripping, and decoloring. Specifically, the invention hydrosulfite compositions exhibit excellent thermal stability, shelf life, and retention of reducing properties. In clearing and scouring dyed synthetic textiles, they provide textiles having bright attractive colors, and good fastness to laundering, drycleaning, crocking, and light. In the package-dyeing of polyester yarn, additionally, they have been found to reduce the redeposition of trimer, the low-molecular-weight polymer fraction present in textile-grade polyesters.

Further, the invention compositions can be used for other applications employing hydrosulfites, such as bleaching agents for synthetic and natural textiles and cleaning agents for dyeing equipment to remove residual dyes and dyeing adjuvants.

In using the hydrosulfite compositions of this invention, the user is assured of having an optimum concentration of each ingredient, while eliminating the inefficiencies and hazards inherent in the use of the prior art materials and procedures. Lastly, but certainly not least, in many applications the use of the invention compositions can save up to 30–40% in the cost of materials and labor.

What is claimed is:

1. A stable hydrosulfite composition which comprises a dry particulate admixture of:

A. 100 parts of a hydrosulfite selected from the group consisting of an alkali metal hydrosulfite, ammonium hydrosulfite, zinc hydrosulfite, and mixtures thereof (based on an assay value of 100% hydrosulfite);

B. 37.5–214 parts of a pH builder selected from the class consisting of sodium, potassium, or ammonium carbonate, sesquicarbonate, or bicarbonate, and mixtures thereof;

C. 37.5–286 parts of a pH buffer selected from the class consisting of trisodium phosphate, tripotassium phosphate, triammonium phosphate, disodium phosphate, dipotassium phosphate, diammonium phosphate, sodium tripolyphosphate, potassium tripolyphosphate, ammonium tripolyphosphate, tetrasodium pyrophosphate, tetrapotassium pyrophosphate, tetrammonium pyrophosphate, a sodium or potassium silicate having a molar ratio of silica to alkali metal oxide of about 0.5 to 3.3, borax, and mixtures thereof; and D. 0.9–14.15 parts of a thermal stabilizer for the hydrosulfite, said thermal stabilizer being a sodium or potassium salt of an alkanoic acid of 1 to 12 carbon atoms or a benzoic acid.

2. Treating a dyed or tinted textile with an aqueous solution containing the composition of claim 1.

3. A stable hydrosulfite composition which comprises a dry particulate admixture of:

A. 100 parts of a hydrosulfite selected from the group consisting of an alkali metal hydrosulfite, ammonium hydrosulfite, zinc hydrosulfite and mixtures thereof (based on an assay value of 100% hydrosulfite);

B. 37.5–214 parts of a pH builder selected from the class consisting of sodium, potassium, or ammonium carbonate, sesquicarbonate, or bicarbonate, and mixtures thereof;

C. 37.5–286 parts of a pH buffer selected from the class consisting of trisodium phosphate, tripotassium phosphate, triammonium phosphate, disodium phosphate, dipotassium phosphate, diammonium phosphate, sodium tripolyphosphate, potassium tripolyphosphate, ammonium tripolyphosphate, tetrasodium pyrophosphate, tetrapotassium pyrophosphate, tetrammonium pyrophosphate, a sodium or potassium silicate having a molar ratio of silica to alkali metal oxide of about 0.5 to 3.3, borax, and mixtures thereof; and D. 3.4–107 parts of an anionic, ampholytic, or nonionic detergent.

4. Treating a dyed or tinted textile with an aqueous solution containing the composition of claim 3.

5. The composition of claim 3 wherein the admixture further comprises 0.9–14.15 parts of a thermal stabilizer for the hydrosulfite, said thermal stabilizer being a sodium or potassium salt of an alkanoic acid of 1–12 carbon atoms or a benzoic acid.

6. Treating a dyed or tinted textile with an aqueous solution containing the composition of claim 5.

7. The composition of claim 5 wherein the hydrosulfite is an alkali metal hydrosulfite, the pH builder is sodium carbonate, the pH buffer is trisodium phosphate, sodium orthosilicate, sodium metasilicate or mixtures thereof, the detergent is a nonionic detergent, and the thermal stabilizer is sodium or potassium benzoate or sodium or potassium acetate.

8. Treating a dyed or tinted textile with an aqueous solution containing the composition of claim 7.

9. The composition of claim 5 wherein the quantity of pH builder is about 75–175 parts, the quantity of pH buffer is about 60–175 parts, the quantity of stabilizer is at least about 3 parts, and the quantity of detergent is at least about 10 parts.

10. Treating a dyed or tinted textile with an aqueous solution containing the composition of claim 9.

11. The composition of claim 9 wherein the hydrosulfite is an alkali metal hydrosulfite, the pH builder is sodium carbonate, the pH buffer is trisodium phosphate, sodium orthosilicate, sodium metasilicate or mixtures thereof, the detergent is a nonionic detergent, and the thermal stabilizer is sodium or potassium benzoate or sodium or potassium acetate.

12. Treating a dyed or tinted textile with an aqueous solution containing the composition of claim 11.

13. A stable hydrosulfite composition which comprises a dry particulate admixture of:

A. 100 parts of a hydrosulfite selected from the group consisting of an alkali metal hydrosulfite, ammonium hydrosulfite, zinc hydrosulfite, and mixtures thereof (based on an assay value of 100% hydrosulfite);

B. 37.5–214 parts of a pH builder selected from the class consisting of sodium carbonate, sodium bicarbonate, and mixtures thereof;

C. 37.5–286 parts of a pH buffer selected from the class consisting of trisodium phosphate, sodium tripolyphosphate, tetrasodium pyrophosphate, sodium metasilicate, borax, and mixtures thereof; and D. a stabilizer for the hydrosulfite in an amount up to 14.15 parts.

14. Treating a dyed or tinted textile with an aqueous solution containing the composition of claim 13.

15. A stable hydrosulfite composition which comprises a dry particulate admixture of:

A. 100 parts of a hydrosulfite selected from the group consisting of an alkali metal hydrosulfite, ammonium hydrosulfite, zinc hydrosulfite and admixtures thereof (based on an assay value of 100% hydrosulfite);

B. 37.5–214 parts of a pH builder selected from the class consisting of sodium carbonate, sodium bicarbonate, and mixtures thereof;

C. 37.5–286 parts of a pH buffer selected from the class consisting of trisodium phosphate, sodium tripolyphosphate, tetrasodium pyrophosphate, sodium metasilicate, borax, and mixtures thereof; and D. an anionic, ampholytic, or nonionic detergent in an amount up to 107 parts.

16. Treating a dyed or tinted textile with an aqueous solution containing the composition of claim 15.

17. The composition of claim 15 wherein the admixture further comprises a stabilizer for the hydrosulfite in an amount up to 14.15 parts.

18. Treating a dyed or tinted textile with an aqueous solution containing the composition of claim 17.

19. The composition of claim 17 wherein the hydrosulfite is an alkali metal hydrosulfite, the pH builder is sodium carbonate, the pH buffer is trisodium phosphate, sodium metasilicate or mixtures thereof, the detergent is a nonionic detergent, and the thermal stabilizer is sodium benzoate.

20. Treating a dyed or tinted textile with an aqueous solution containing the composition of claim 19.

* * * * *

UNITED STATES PATENT AND TRADEMARK OFFICE

CERTIFICATE OF CORRECTION

PATENT NO. : 4,066,390
DATED : January 3, 1978
INVENTOR(S) : Nick J. Christie et al.

It is certified that error appears in the above-identified patent and that said Letters Patent are hereby corrected as shown below:

Column 1, line 1, "USS" should read - U.S. - ; line 39, "solium" should read - sodium - ; line 62, "textiletype" should read - textile-type - .

Column 2,
line 18, "cleaning" should read - clearing - ; line 49, "present" should read - presently - .

Column 5, line 15, delete "of"; line 19, after "in" insert - an - ; line 47, delete "it".

Column 6, line 48, "spinextracted" should read - spin-extracted -.

Column 9, line 33, "indentical" should read - identical - ;

Signed and Sealed this

Sixth Day of June 1978

[SEAL]

Attest:

RUTH C. MASON
Attesting Officer

DONALD W. BANNER
Commissioner of Patents and Trademark